United States Patent [19]

Motov et al.

[11] Patent Number: 4,504,271

[45] Date of Patent: Mar. 12, 1985

[54] LEATHER TANNING AGENT AND PROCESS FOR MAKING SAME

[76] Inventors: David L. Motov, ulitsa Fersmana, 18, kv. 19; Ljudmila P. Tjurkina, ulitsa Severnaya, 19, kv. 90; Maria M. Godneva, ulitsa Fersmana, 18, kv. 19, all of Apatity, Murmanskaya oblast; Nina I. Kolesnikova, ulitsa 15 Parkovaya, 23, kv. 20, Moscow; Galina G. Yakusheva, ulitsa Shkolnaya, 76, kv. 29, Vidnoe, Moskovskaya oblast, all of U.S.S.R.; Metelkin A. Ivanovich, deceased, late of Moscow, U.S.S.R.; by Chibisova N. Fedorovna, administrator, ulitsa Nagornaya, 24, korpus 6, kv. 31, Moscow, U.S.S.R.

[21] Appl. No.: 460,235

[22] PCT Filed: May 19, 1981

[86] PCT No.: PCT/SU81/00043

§ 371 Date: Jan. 18, 1983

§ 102(e) Date: Jan. 18, 1983

[87] PCT Pub. No.: WO82/04071

PCT Pub. Date: Nov. 25, 1982

[51] Int. Cl.[3] ..... C14C 3/04

[52] U.S. Cl. ..... 8/94.25; 8/94.29

[58] Field of Search ..... 8/94.25

[56] References Cited

U.S. PATENT DOCUMENTS 3,423,162 1/1969 Papayannis et al. ..... 8/94.25

FOREIGN PATENT DOCUMENTS 783342 11/1980 U.S.S.R. ..... 8/94.25

859455 8/1981 U.S.S.R. ..... 8/94.25

*Primary Examiner*—Maria Parrish Tungol

*Attorney, Agent, or Firm*—Lilling & Greenspan

[57] ABSTRACT

A leather tanning agent characterized in that it contains the following components, percent by weight:

| | |
|---|---|
| sulphate of aluminum and ammonium containing 0.001 to 1.0% of $TiO_2$ or $TiO_2$ and $ZrO_2$ | 3 to 20 |
| and/or sulphate of zirconium and ammonium containing 0.001 to 0.5% of $TiO_2$ or $TiO_2$ and $Al_2O_3$ | 20 to 50 |
| and sulphate of titanyl and ammonium containing of 0.001 to 1.0% of $Al_2O_3$ and/or $ZrO_2$ | the balance. |

The above-mentioned additives of $TiO_2$, $ZrO_2$ and $Al_2O_3$ incorporated in the sulphates are present therein in a chemically combined state.

In the process for producing the leather tanning agent a titanium-containing solution with a concentration of titanium of from 80 to 200 g/l as calculated for titanium dioxide is reacted with a solution of aluminum sulphate containing 80 to 130 g/l of aluminum as calculated for alumina, and/or a solution of zirconium sulphate containing 50 to 200 g/l of zirconium as calculated for zirconium dioxide in the presence of sulphuric acid and ammonium sulphate.

The sulphate tanning agent according to the present invention can be very useful in the leather industry.

15 Claims, No Drawings

LEATHER TANNING AGENT AND PROCESS FOR MAKING SAME

FIELD OF THE ART

The present invention relates to the leather industry and, more specifically, to a leather tanning agent and to a process for making same.

The prior art tanning agents employed in the leather industry include chrome tanning agents and vegetable tanning agents comprising extracts of oak, spruce, willow, chestnut, quebracho, mimosa, and the like. The use of chromium is harmful for operating personnel, and causes environmental pollution. The use of vegetable tanning agents requires considerable amounts of vegetable raw materials, thus, also rendering damage to the environment.

DESCRIPTION OF THE PRIOR ART

Known in the art is a titanium tanning agent for hides comprising a double sulphate of titanyl and ammonium in the monohydrate form $(NH_4)_2TiO(SO_4)_2.H_2O$ (cf. USSR Inventor's Certificate No. 234598, Cl. 28a published in 1969). The use of titanium tanning agent eliminates the necessity of using vegetable tanning agents and considerably reduces the rate of consumption of chrome tanning agents. Titanium tanning agents make it possible to efficiently carry out the process of tanning hides. The hides acquire improved characteristics, but the temperature of tanned pelt shrinking does not reach the desired value.

Also known in the art is a zirconium leather tanning agent which, when compared to the titanium tanning agent, increases the temperature of tanned pelt shrinking (cf. A. I. Metelkin, N. I. Kolesnikova, E. V. Kuz'mina "Zirconium Tanning", 1972, "Legkaya Industriya" (Light Industry) Publishing House, Moscow, p. 220). However, the zirconium tanning agent is more expensive than the titanium tanning agent.

A tanning agent is also known, which contains both titanium and zirconium, the application of which results in an improved quality of leather (cf. USSR Inventor's Certificate No. 340702, Cl. 28a, 1972).

The process for the manufacture of this tanning agent comprises the steps of mixing two solutions: a solution containing a salt of titanium and a solution containing a salt of zirconium, whereafter the solutions are evaporated to dryness. This process involves increased power input.

SUBJECT OF THE INVENTION

The present invention is directed to a leather tanning agent that is superior to the prior art tanning agents (including titanium) in its properties and could be produced by a simple process using readily available reagents and mineral stock materials.

The objective of the invention is accomplished by providing a leather tanning agent incorporating sulphate of titanyl and ammonium, which, according to the present invention, contains the following components, in percent by weight:

| | |
|---|---|
| sulphate of aluminum and ammonium containing 0.001 to 1.0% of $TiO_2$ or $TiO_2$ and $ZrO_2$ | 3 to 20 |
| and/or sulphate of zirconium and ammonium containing 0.001 to 0.5% of $TiO_2$ | 20 to 50 |

-continued

| | |
|---|---|
| or $TiO_2$ and $Al_2O_3$ and sulphate of titanyl and ammonium containing of 0.001 to 1.0% of $Al_2O_3$ and/or $ZrO_2$ | the balance. |

The above-stated additives of $TiO_2$, $ZrO_2$ and $Al_2O_3$ incorporated in the above-specified sulphates are present therein in a chemically combined state.

The tanning agent of such composition has the advantage that it enables effective tanning of hides so as to impart excellent physico-mechanical characteristics thereto.

The term "sulphate of ammonium and aluminum" is used here to denote a compound of the formula $NH_4AL(SO_4)_2.12H_2O$, which contains chemically combined additives of $TiO_2$ or $TiO_2$ and $ZrO_2$.

The term "sulphate of zirconium and ammonium" is used here to denote a compound of the formula $(NH_4)_2Zr_2(OH)_5.(SO_4)_{2,5}.H_2O$, which contains chemically combined additives of $TiO_2$ or $TiO_2$ and $Al_2O_3$.

The term "sulphate of titanyl and ammonium" is used to denote a compound of the formula $(NH_4)_2TiO(SO_4)_2.H_2O$, which contains chemically combined additives of $Al_2O_3$ and/or $ZrO_2$.

The tanning agent of the present invention is produced by a process which, according to the present invention, comprises reacting a solution containing 80 to 200 g/l of titanium as calculated for titanium dioxide with a solution of aluminum sulphate containing 80 to 130 g/l of aluminum as calculated for aluminum oxide, and/or a solution of zirconium sulphate containing 50 to 200 g/l of zirconium as calculated for zirconium oxide in the presence of sulphuric acid and ammonium sulphate.

The process for producing the tanning agent according to the present invention is advantageous in that it can be readily realized on a commercial scale, since the process is carried out under ambient conditions: at room temperature and ambient pressure with the use of readily available and inexpensive reagents and mineral raw materials.

PREFERRED EMBODIMENTS OF THE INVENTION

The following embodiments of the composition of the sulphate tanning agent are covered by the present invention, depending on the combination of the sulphates employed, namely, 2-component and 3-component tanning agents.

A titanium-aluminum tanning agent has the following composition, percent by weight:

| | |
|---|---|
| sulphate of aluminum and ammonium containing 0.001 to 1.0% of $TiO_2$ | 3 to 20 |
| sulphate of titanyl and ammonium containing 0.001 to 1.0% of $Al_2O_3$ | the balance. |

This tanning agent makes it possible to increase the temperature of tanned pelt shrinking by 4°–6° C. as compared to the prior art titanium tanning agent.

A titanium-zirconium tanning agent has the following composition, percent by weight:

| | |
|---|---|
| sulphate of zirconium and ammonium containing 0.001 to 0.1% of $TiO_2$ | 20 to 50 |

-continued

| | |
|---|---|
| sulphate of titanyl and ammonium containing 0.001 to 0.1% of $ZrO_2$ | the balance. |

This tanning agent makes it possible to increase the shrinking temperature of pelt tanned therewith by 8°-9° C. as compared to the prior art titanium tanning agent.

A titanium-zirconium-aluminum tanning agent has the following composition percent by weight:

| | |
|---|---|
| sulphate of aluminum and ammonium containing 0.001 to 1.0% of $TiO_2$ and $ZrO_2$ | 3 to 20 |
| sulphate of zirconium and ammonium containing 0.001 to 0.5% of $TiO_2$ and $Al_2O_3$ | 20 to 50 |
| sulphate of titanyl and ammonium containing 0.001 to 1.0% of $Al_2O_3$ and $ZrO_2$ | the balance. |

This tanning agent makes it possible to increase the shrinking temperature of pelt tanned therewith by 10°-12° C. as compared to the prior art titanium tanning agent.

The titanium-aluminum tanning agent according to the present invention can also include 1 to 10% by weight of silicic acid which serves as a filler for leather and makes it possible to increase its yield by weight and thickness after tanning by 0.8 to 1.0% as compared to the prior art titanium tanning agent.

The choice of the content ranges of the above-specified sulphates in the tanning agent according to the present invention is dictated by the amount of the sulphates of aluminum and ammonium. Thus, if the sulfates of aluminum and ammonium are less than 3% by weight, no activation of the tanning effect of titanyl and ammonium sulphate is displayed by the tanning agent. An increase in the amount of sulphates of aluminum and ammonium above 20% by weight causes a reduction of the amount of the main tanning component, i.e. of sulphate of titanyl and ammonium, which results in a reduction of the tanning properties.

Where the amount of the sulphates of zirconium and ammonium in the tanning agent is less than 20% by weight, its tanning effect is weakened, whereas, with the amount of this component exceeding 50% by weight, the tanning effect of titanium is suppressed by zirconium and, moreover, this adds to the cost of the tanning agent.

The choice of concentration ranges of additives of $TiO_2$, $ZrO_2$ and $Al_2O_3$ chemically combined in sulphates is dictated by the fact that below 0.001% by weight they do not display the effect of activation of sulphates in tanning, whereas the upper limit of the range is defined by the conditions of the process for the production of the tanning agent.

The following embodiments of the process for producing the tanning agent according to the present invention are possible depending on the character of the tanning agent to be produced: titanium-aluminum, or titanium-zirconium, or titanium-zirconium-aluminum.

According to the present invention, the titanium-aluminum tanning agent is produced by a process wherein a solution of sulphate of titanyl and ammonium containing 80 to 140 g/l of titanium, as calculated for titania, is added to ammonium sulphate and sulphuric acid until crystallization of the sulphates of titanyl and ammonium begins. Thereafter a solution of aluminum sulphate and additionally ammonium sulphate and sulphuric acid are added during a period of from 1 to 5 hours until the total content of free sulphuric acid and aluminum sulphate in the reaction solution becomes equal to 400-600 g/l and the molar ratio of aluminum to titanium is equal to 0.03-0.24:1.

The titanium-aluminum tanning agent can also be produced from a sulphuric acid solution containing 100 to 200 g/l of titanium as calculated for titania and 300 to 520 g/l of sulphuric acid, this solution resulting from processing of titanium-containing stock materials. Ammonium sulphate is added to this solution, until the resulting sulphate of titanyl and ammonium begins to crystallize, whereafter a solution of aluminum sulphate and additionally ammonium sulphate are added until the content of free ammonium sulphate in the reaction solution becomes 210 to 350 g/l and the molar ratio of aluminum-to-titanium is 0.03-0.24:1.

The use of the above-mentioned sulphuric acid solution has the following advantages: (1) there is no need in special recovery of titanyl and ammonium sulphate therefrom; (2) the degree of precipitation of titanium from this sulphate solution is higher than from the solution of sulphate of titanyl and ammonium, and (3) the resulting product has better tanning properties.

To enhance tanning characteristics of the titanium-aluminum tanning agent, the process for producing it is conducted with the addition of 1 to 10% by weight of silicic acid or its sodium salt. Silicic acid incorporated in the tanning agent composition serves as a filler and increases the yield of leather both in weight and thickness.

According to the present invention, the process for producing a titanium-zirconium tanning agent comprises introduction into a zirconium-containing solution of ammonium sulphate and sulphuric acid until the beginning of crystallization of the forming sulphate of zirconium and ammonium, whereafter during a period of from 1 to 5 hours a solution of sulphate of titanyl and ammonium is added containing 80 to 140 g/l of titanium as calculated for titania, and additionally ammonium sulphate and sulphuric acid is also introduced until the total content of free ammonium sulphate and sulphuric acid in the reaction solution becomes equal to 770-1,000 g/l and the molar ratio of zirconium to titanium is equal to 0.10-0.65:1.

Described hereinbelow are two embodiments of the process for producing a titanium-zirconium-aluminum tanning agent. In one embodiment a zirconium-containing solution is added to ammonium sulphate and sulphuric acid until the moment of crystallization of the resulting sulphate of zirconium and ammonium. Thereafter during a period of from 1 to 5 hours it is added to a solution of ammonium titanyl containing 80 to 140 g/l of titanium as calculated for titania, a solution of aluminum sulphate, and additionally with ammonium sulphate and sulphuric acid until the total content of free ammonium sulphate and sulphuric acid in the reaction solution becomes equal to 770-1,000 g/l and the molar ratio of aluminum and zirconium to titanium is equal to 0.03-0.24:0.10-0.65:1.

Another embodiment of the process for producing the titanium-zirconium-aluminum tanning agent comprises addition into a zirconium-containing solution of a sulphuric acid solution containing 100 to 200 g/l of titanium based on titania and 300 to 520 g/l of sulphuric acid obtained from processing a titanium-containing raw material for a period of from 6 to 10 hours, along with a solution of aluminum sulphate and ammonium sulphate till the content of free ammonium sulphate in the reaction solution is 400 to 580 g/l and the molar ratio of aluminum and zirconium to titanium is equal to 0.03–0.24:1.10–0.65:1.

In all the embodiments the process for producing a sulphate tanning agent is effected at room temperature under normal pressure. The starting raw materials and reagents are readily available materials.

For the preparation of a titanium-containing solution use is made either of sulphate of titanyl and ammonium obtained from processing a titanium-containing raw material, or of this raw material after treatment thereof with sulphuric acid. As said raw material use can be made of ilmenite concentrate, sphene concentrate, leucoxene concentrate, and other concentrates of titanium materials.

For the preparation of a zirconium-containing solution use is made of zirconium sulphate obtained from processing a zirconium containing raw material, for example, zircon concentrate.

For a better understanding of the present invention some specific examples illustrating the production of the tanning agent are given hereinbelow.

EXAMPLE 1

500 g of sulphate of titanyl and ammonium are dissolved in 1 liter of water to obtain a solution containing 100 g/l of titanium as calculated for its dioxide.

Into the resulting solution ammonium sulphate and sulphuric acid are added until the beginning of crystallization of sulphate of titanyl and ammonium, whereafter during 2 hours there is added 0.04 l of the solution of aluminum sulphate containing 113 g/l of aluminum as calculated for its oxide and additionally aluminum sulphate and sulphuric acid until the total content of free sulphuric acid and ammonium sulphate in the reaction solution is 550 g/l and the molar ratio of aluminum to titanium is equal to 0.05–1. The resulting precipitate is separated from the solution by filtration.

The final product yield is 540 g. It contains, percent by weight: $TiO_2$, 18.2; $Al_2O_3$, 1.2. It consists of two sulphates, percent by weight:

| | |
|---|---|
| sulphate of aluminum and ammonium containing 0.5% of $TiO_2$ | 13 |
| sulphate of titanyl and ammonium containing 0.5% of $Al_2O_3$ | the balance. |

EXAMPLE 2

Use is made of 1 liter of a sulphuric acid solution obtained from processing a titanium-containing stock containing 160 g/l of titanium as calculated for its dioxide and 400 g/l of sulphuric acid. Into this solution ammonium sulphate is added till the beginning of crystallization of the forming sulphate of titanyl and ammonium, whereafter during 8 hours it is added to 0.2 l of a solution of aluminum sulphate containing 113 g/l of aluminum as calculated for alumina, and additionally ammonium sulphate until the content of free ammonium sulphate in the solution becomes equal to 300 g/l and the molar ratio of aluminum to titanium is 0.20:1. The precipitate is separated from the solution by filtration.

The yield of the final product is 980 g. It contains, percent by weight: $TiO_2$, 16.3; $Al_2O_3$, 2.05. It consists of two sulphates, percent by weight:

| | |
|---|---|
| sulphate of aluminum and ammonium containing 0.6% $TiO_2$ | 17.8 |
| sulphate of titanyl and ammonium containing 0.6% of $Al_2O_3$ | the balance. |

EXAMPLE 3

The process is conducted as described in the foregoing Examples 1 and 2, except that after the introduction of the components, silicic acid is added in an amount of 3.8 g (in the experiment of Example 1) and 6.0 g (in the experiment of Example 2).

In the final product the weight ratio of silicic acid to titanium dioxide is 0.05:1.

EXAMPLE 4

0.5 liters of a solution of zirconium sulphate containing 180 g/l of zirconium as calculated for its dioxide is added to sulphuric acid and ammonium sulphate until the total content of free sulphuric acid and ammonium sulphate becomes equal to 770 g/l. This results in crystallization of the formed sulphate of zirconium and ammonium from the solution. Into the reaction solution during two hours there is added 1 liter of a solution of sulphate of titanyl and ammonium containing 117 g/l of titanium as calculated for its dioxide, and additionally ammonium sulphate and sulphuric acid to a total content of free sulphuric acid and ammonium sulphate of 820 g/l and the molar ratio of zirconium to titanium of 0.5:1. The suspension is allowed to stand for 24 hours. The precipitate is separated by filtration.

The product yield is 1,000 g. It contains, percent by weight: $TiO_2$, 11.0; $ZrO_2$, 8.5 The product consists of two sulphates, percent by weight:

| | |
|---|---|
| sulphate of zirconium and ammonium containing 0.005% of $TiO_2$ | 45 |
| sulphate of titanyl and ammonium containing 0.005% of $ZrO_2$ | the balance. |

EXAMPLE 5

Use is made of 0.5 liters of a solution of zirconium containing 180 g/l of zirconium as calculated for its dioxide. During 8 hours the solution is added to 1 liter of a sulphuric acid solution obtained from processing a titanium-containing raw material containing 160 g/l of titanium as calculated for its dioxide and 400 g/l of sulphuric acid, as well as ammonium sulphate until the content of free ammonium sulphate in the solution is 500 g/l and the molar ratio of zirconium to titanium is 0.35:1. The suspension is allowed to stand for 35 hours. The precipitate is separated by filtration.

The yield of the final product is 1,200 g. It contains, percent by weight: $TiO_2$, 12.9; $ZrO_2$, 7.3. The product consists of two sulphates, percent by weight: sulphate of zirconium and ammonium containing 0.006% of $TiO_2$ 35 sulphate of titanyl and ammonium containing 0.006% of $ZrO_2$ the balance.

EXAMPLE 6

Use is made of 0.5 liters of a solution of zirconium sulphate containing 180 g/l of zirconium as calculated for zirconia. Sulphuric acid and ammonium sulphate are added to this solution until the total content of free ammonium sulphate and sulphuric acid becomes equal to 770 g/l. The formed sulphate of ammonium and zirconium starts to crystallize out of the solution. Into the reaction solution there are added during 1 hour 1.5 liters of a solution of sulphate of titanyl and ammonium containing 100 g/l of titanium as calculated for titania, 0.05 liters of a solution of aluminum sulphate containing 113 g/l of aluminum as calculated for alumina, and additionally sulphuric acid and ammonium sulphate till the total content of free sulphuric acid and ammonium sulphate in the solution is 820 g/l and the molar ratio of aluminum and zirconium to titanium is made equal to 0.05:0.40:1. The suspension is allowed to stand for 20 hours. The precipitate is separated by filtration.

The yield of the final product is 1,500 g. It contains, percent by weight: $TiO_2$, 9.5; $ZrO_2$, 5.9; $Al_2O_3$, 0.3.

The product consists of three sulphates, percent by weight:

| | |
|---|---|
| sulphate of aluminum and ammonium containing 0.5% of $TiO_2$ and $ZrO_2$ | 3 |
| sulphate of zirconium and ammonium containing 0.2% of $TiO_2$, and $Al_2O_3$ | 45 |
| sulphate of titanyl and ammonium containing 0.4% of $Al_2O_3$ and $ZrO_2$ | the balance. |

EXAMPLE 7

Use is made of 0.5 liters of a solution of zirconium sulphate containing 150 g/l of zirconium as calculated for its dioxide. Into this solution there are added during 8 hours, 1.7 liters of a sulphate solution obtained from processing of a titanium-containing raw material containing 160 g/l of titanium as calculated for its dioxide and 400 g/l of sulphuric acid, 0.04 liters of a solution of aluminum sulphate containing 113 g/l of aluminum as calculated for its oxide, and ammonium sulphate until the content of free ammonium sulphate in the reaction solution is 500 g/l and the molar ratio of aluminum and zirconium to titanium is 0.18:0.20:1. The suspension after the addition of the reagents, is allowed to stand for 40 hours. The precipitate is separated by filtration.

The weight of the precipitate is 1,885 g. It contains, percent by weight: $TiO_2$, 14.0; $ZrO_2$, 4.3; $Al_2O_3$, 2.8. The product consists of three sulphates, percent by weight:

| | |
|---|---|
| sulphate of aluminum and ammonium containing 0.5% of $TiO_2$ and $ZrO_2$ | 20 |
| sulphate of zirconium and ammonium containing 0.2% of $TiO_2$ and $Al_2O_3$ | 21 |
| sulphate of titanyl and ammonium containing 0.6% of $Al_2O_3$ and $ZrO_2$ | the balance. |

The process according to Examples 1 through 7 is performed under normal conditions, i.e. at room temperature and normal pressure.

Tanning properties of the products according to the shrinking temperature of the pelt treated therewith (are given in the table hereinbelow).

TABLE

| Tanning properties of the products | |
|---|---|
| Tanning agent 1 | Temperature of tanned pelt shrinking, °C. 2 |
| Sulphate of titanyl and ammonium (prior art titanium tanning agent) | 85 |
| Titanium-aluminum tanning agent | 89 |

TABLE-continued

| Tanning properties of the products | |
|---|---|
| Tanning agent 1 | Temperature of tanned pelt shrinking, °C. 2 |
| according to Example 1 | |
| Titanium-aluminum tanning agent according to Example 2 | 91 |
| Titanium-aluminum-silicon tanning agent according to Example 3 | 92 |
| Titanium-zirconium tanning agent according to Example 4 | 93 |
| Titanium-zirconium tanning agent according to Example 5 | 94 |
| Titanium-zirconium-aluminum tanning agent according to Example 6 | 95 |
| Titanium-zirconium-aluminum tanning agent according to Example 7 | 97 |

From the data showing the shrinking temperature of pelt tanned with the above-specified tanning agents it follows that the tanning agent according to the present invention produced as described in Examples 1 through 7 improves the quality of leather as compared to the prior art titanium tanning agent.

The best characteristics as regards the temperature of tanned pelt shrinking are attained in the case of the titanium-zirconium-aluminum tanning agent produced with the use of a sulphate solution resulting from processing a titanium-containing raw material (Example 7).

Enhanced tanning characteristics of the tanning agent of the present invention as compared to those of the prior art tanning agents are due to the use of a combination of sulphates incorporating, as it has been already specified hereinbefore, additives of $TiO_2$, $ZrO_2$ and $Al_1O_3$.

INDUSTRIAL APPLICABILITY

The present invention can be used in the leather industry for leather processing.

What we claim is:

1. A process for producing a leather tanning agent, comprising reacting (a) solution containing 80 to 200 g/l of titanium, as calculated for its dioxide, with (b) a solution of aluminum sulphate containing from 80 to 130 g/l of aluminum, as calculated for its oxide, and (c) a solution of zirconium sulphate containing 50 to 200 g/l of zirconium, as calculated for its dioxide, in the presence of sulphuric acid and ammonium sulphate.

2. The process of claim 1, wherein the titanium solution (a) is sulphate of titanyl and ammonium containing from 80 to 140 g/l of titanium, as calculated for its dioxide, which is added to ammonium sulphate and sulphuric acid until crystallization of the sulphate of titanyl and ammonium begins, thereafter adding a solution of sulphate of ammonium and sulphuric acid for 1 to 5 hours, to obtain a total content of free sulphuric acid and ammonium sulphate of 400 to 600 g/l, and a molar ratio of aluminum to titanium of 0.03–0.24:1.

3. The process according to claim 1, wherein said solution (a) is a sulphate solution obtained from processing a titanium raw material containing 100 to 200 g/l of titanium, as calculated for its dioxide, and 300 to 520 g/l of sulphuric acid; this titanium sulphate solution being added to ammonium sulphate until crystallization of the formed sulphate of titanyl and ammonium begins, thereafter adding a solution of aluminum sulphate along with an additional amount of ammonium sulphate for a period of from 6 to 10 hours to obtain a free ammonium sulphate content in the reaction solution of 210 to 350 g/l and a molar ratio of aluminum to titanium of 0.03–0.24:1.

4. A process according to claim 3, wherein silicic acid or its sodium salt is added to obtain a molar ratio of silicon to titanium of 0.07–0.70:1.

5. The process of claim 1, wherein ammonium sulphate and sulphuric acid are added to said zirconium sulphate solution until crystallization of the formed sulphate of zirconium and ammonium begins, thereafter adding a solution of sulphate of titanyl and ammonium containing 80 to 140 g/l of titanium, as calculated for its dioxide, for 1 to 5 hours, and adding ammonium sulphate and sulphuric acid until obtaining a total content of free ammonium sulphate and sulphuric acid in the reaction solution of from 770 to 1,000 g/l and a molar ratio of zirconium to titanium of 0.10–0.65:1.

6. The process of claim 5, wherein after the crystallization of the sulphate of ammonium and zirconium begins, a solution of aluminum sulphate is added thereto until obtaining a molar ratio of aluminum and zirconium to titanium in the solution equal to 0.03–0.24:0.-10–0.65:1, respectively.

7. The process according to claim 1, wherein a sulphate solution is added to the zirconium solution (c) for a period of from 6 to 10 hours; said sulphate solution obtained from the processing of a titanium raw material containing 100 to 200 g/l of titanium, as calculated for its dioxide, and 300 to 520 g/l of sulphuric acid and ammonium sulphate, until obtaining a content of free ammonium sulphate in the reaction solution of from 400 to 580 g/l and a molar ratio of zirconium to titanium of 0.10–0.65:1.

8. The process of claim 7, wherein a solution of aluminum sulphate is added to the reaction solution to obtain a molar ratio of aluminum and zirconium to titanium in the solution of 0.03–0.24:0.10–0.65:1, respectively.

9. A leather tanning agent with components selected from the group consisting of:

(a) 3 to 20% sulphate of aluminum and ammonium, containing 0.001 to 1.0% of $TiO_2$, or $TiO_2$ and $ZrO_2$, (b) 20 to 50% sulphate of zirconium and ammonium, containing 0.001 to 0.5% of $TiO_2$ or $TiO_2$ and $Al_2O_3$, and (c) mixtures of (a) and (b); the balance of said leather tanning agent comprising sulphate of titanyl and ammonium containing 0.001 to 1.0% of $Al_2O_3$ or $Al_2O_3$ and $ZrO_2$.

10. The tanning agent of claim 9, comprising, in % by weight:

3 to 20% sulphate of aluminum and ammonium containing 0.001 to 1.0% of $TiO_2$, and the balance comprising sulphate of titanyl and ammonium containing 0.001 to 1.0% of $Al_2O_3$.

11. The tanning agent of claim 10, also containing 1 to 10% by weight of silicic acid.

12. The tanning agent of claim 9, comprising, in % by weight:

20 to 50% sulphate of zirconium and ammonium containing 0.001 to 1.0% of $TiO_2$, the balance comprising sulphate of titanyl and ammonium containing 0.001 to 1.0% of $CrO_2$.

13. The tanning agent of claim 9, comprising, in % by weight:

3 to 20% sulphate of aluminum and ammonium containing 0.001 to 1.0% of $TiO_2$ and $ZrO_2$, 20 to 50% sulphate of zirconium and ammonium containing 0.001 to 0.5% of $TiO_2$ and $Al_2O_3$, and the balance comprising sulphate of titanyl and ammonium containing 0.001 to 1.0% of $Al_2O_3$ and $ZrO_2$.

14. The tanning agent of claim 9, wherein $TiO_2$, $ZrO_2$ and $Al_2O_3$ contained in the sulphates are present in a chemically combined state.

15. A process for producing a leather tanning agent, comprising the steps of:

(a) reacting a solution containing 80–200 g/l of titanium as calculated for its dioxide, with ammonium sulphate and sulphuric acid until the start of crystallization of sulphate of titanyl and ammonium;

(b) adding to the mixture of step (a), a solution selected from the group consisting of:

(i) an aluminum sulphate solution containing 80–130 g/l of aluminum as calculated for its oxide, (ii) a zirconium sulphate solution containing 50–200 g/l of zirconium as calculated for its dioxide, (iii) and mixtures thereof;

(c) further adding sulphuric acid and ammonium sulphate for a period of 1 to 5 hours until the reacting solution has a total content of free sulphuric acid and ammonium sulphate, of 400–600 g/l, and the aluminum to titanium molar ratio is 0.03–0.24:1, respectively;

(d) separating the resulting sediment from the solution.

* * * * *